US010233684B2

(12) United States Patent
Pyo

(10) Patent No.: US 10,233,684 B2
(45) Date of Patent: Mar. 19, 2019

(54) FURNITURE HINGE FOR INCREASING JUMPING LENGTH OF FURNITURE DOOR

(71) Applicant: Samsung Precision Ind. Co., Ltd., Incheon (KR)

(72) Inventor: Chul Soo Pyo, Gwacheon-si (KR)

(73) Assignee: Samsung Prescision Ind. Co., Ltd., Incheon (KR)

( * ) Notice: Subject to any disclaimer, the term of this patent is extended or adjusted under 35 U.S.C. 154(b) by 0 days.

(21) Appl. No.: 15/650,169

(22) Filed: Jul. 14, 2017

(65) Prior Publication Data

US 2018/0016825 A1 Jan. 18, 2018

(30) Foreign Application Priority Data

Jul. 18, 2016 (KR) ..... 10-2016-0090910

(51) Int. Cl.
*E05D 7/04* (2006.01)
*E05D 7/00* (2006.01)
(Continued)

(52) U.S. Cl.
CPC ..... *E05D 7/0009* (2013.01); *E05D 3/142* (2013.01); *E05D 7/0407* (2013.01);
(Continued)

(58) Field of Classification Search
CPC ... E05D 7/0009; E05D 7/0423; E05D 7/0054; E05D 7/04; E05D 7/0407; E05D 7/0415;
(Continued)

(56) References Cited

U.S. PATENT DOCUMENTS 5,022,116 A * 6/1991 Salice ..... E05D 7/0407 16/258
5,493,759 A * 2/1996 Salice ..... E05D 7/0407 16/238
(Continued)

FOREIGN PATENT DOCUMENTS

JP H0730649 B2 1/1991
JP 2000314263 A 11/2000
(Continued)

OTHER PUBLICATIONS

Decision to Grant a Patent dated Feb. 8, 2017 issued in corresponding KR 10-2016-0090910; 3 pgs.
(Continued)

*Primary Examiner* — Emily M Morgan
(74) *Attorney, Agent, or Firm* — Maier & Maier, PLLC

(57) ABSTRACT

A furniture hinge mounted between a furniture wall and a furniture door so as to be used as an opening and closing mechanism of the furniture door, in which, by using the movement part provided on the body part of the furniture hinge and the adjustment part provided at the movement path of the movement part, the entire length of the furniture hinge is changed by advancing and returning the movement part in the opening and closing process of the furniture door such that, since the furniture wall and the furniture door do not come into contact with each other even though the furniture door is completely opened, the peeling damage to the exterior of the furniture is prevented and contact noise is eliminated, thereby improving the satisfaction of consumers.

2 Claims, 9 Drawing Sheets

(51) Int. Cl.
*E05D 3/14* (2006.01)
*E05D 3/18* (2006.01)

(52) U.S. Cl.
CPC .... *E05D 7/0423* (2013.01); *A47B 2230/0014* (2013.01); *E05D 3/18* (2013.01); *E05D 7/00* (2013.01); *E05D 7/0415* (2013.01); *E05Y 2800/102* (2013.01); *E05Y 2900/20* (2013.01)

(58) Field of Classification Search
CPC .... E05D 2007/0438; E05D 2007/0446; E05D 2007/0476
See application file for complete search history.

(56) References Cited

U.S. PATENT DOCUMENTS 7,213,300 B1* 5/2007 Domenig ..... E05D 7/04 16/236
9,874,049 B1* 1/2018 McGregor ..... E05F 3/20
2004/0163213 A1* 8/2004 Isele ..... E05D 7/0407 16/245
2006/0137139 A1* 6/2006 Wu ..... E05D 7/0415 16/236
2011/0072617 A1* 3/2011 Lin ..... E05F 5/006 16/298
2012/0186042 A1* 7/2012 Salice ..... E05D 11/1021 16/297
2013/0219659 A1* 8/2013 Oshima ..... E05D 7/0407 16/236
2015/0191952 A1* 7/2015 Pyo ..... E05D 7/0407 16/239

FOREIGN PATENT DOCUMENTS

KR 1020070045022 B1 10/2007
KR 1020120030704 A 10/2013

OTHER PUBLICATIONS

Office Action dated Nov. 28, 2016 issued in corresponding KR 10-2016-0090910; 9 pgs.

* cited by examiner

FURNITURE HINGE FOR INCREASING JUMPING LENGTH OF FURNITURE DOOR

BACKGROUND OF THE INVENTION

Field of the Invention

The present invention relates to a furniture hinge provided to a furniture wall so as to be used as an opening and closing means of a furniture door and, more particularly, to a furniture hinge for increasing the jumping length of a furniture door, in which the length of the furniture hinge is changed according to the opening or closing amount of the furniture door so as to prevent damage as well as noise owing to the friction between the furniture door and a furniture wall.

Background Art

Generally, a furniture hinge is a steel structure provided to a furniture wall and a furniture door so as to be used as an opening and closing means of the furniture door. As for such a furniture hinge, it is important to minimize the noise and movement that might be generated in the opening and closing process of the furniture door, as well as improve the operability required in the installation process and setting process of the furniture door.

As an example, as shown in FIGS. 1 to 3, a furniture hinge 100 includes a body part 110, a door fixing part 120 coupled to a furniture door D by a bolt in a state, in which the door fixing part 120 is coupled to one end portion of the body part 110 through a door hinge 140, and a wall fixing part 130 coupled to a furniture wall B by a bolt in a state, in which the wall fixing part 130 is coupled to the lower surface of the body part 110.

In addition, as shown in FIGS. 1 to 3, the hinge part 140 includes an upper rotation plate 142 hinge-coupled to the body part 110 and the door fixing part 120 so as to provide elastic force, and a lower rotation plate 144 hinge-coupled to the body part 110 and the door fixing part 120 so as to guide the operation of the upper rotation plate 142.

Therefore, if the furniture door D is opened in a state, in which the furniture hinge 100 is provided in furniture such as a dresser or a sink, the furniture door D is rotated and opened along hinge shafts 125, which connect the body part 110 and the hinge part 140 respectively, in the sequence shown in FIG. 3.

However, the furniture hinge 100 is a structure, in which the opening or closing amount of the furniture door D is determined only according to the rotation angle of the hinge part 140. Therefore, when the furniture door D is completely opened, the furniture door D and the furniture wall B are in contact with each other at a portion "A" shown in FIG. 2, thereby generating noise or damage.

That is, the furniture hinge 100 has a structure, in which the upper/lower rotation plates 142, 144 rotate only along the hinge shafts 125, wherein, when the furniture door D is opened at an angle of 90 degrees or more, the corner portion of the furniture door D is struck on the outer wall of the furniture wall B and is damaged, so that the service life of the furniture is lowered.

Thus, there is an acute need for research to completely block the contact between the corner portion of the furniture door D and the outer wall of the furniture wall B in the opening process of the furniture door D so as to prevent damage to the furniture door D or the furniture wall B as well as contact noise and frictional resistance, thereby maximizing the satisfaction of consumers.

PRIOR ART DOCUMENTS

Prior Art Document 1: Registered Patent Publication No. KR 10-0770372 (Registered: 19 Oct. 2007)

Prior Art Document 2: Patent Laid-open Publication No. KR 10-2013-0108883 (Published: 7 Oct. 2013)

SUMMARY OF THE INVENTION

Accordingly, the present invention has been made to solve the above-mentioned problems occurring in the prior arts, and it is an objective of the present invention to provide a furniture hinge for increasing the jumping length of a furniture door, in which the length of the furniture hinge is changed according to the opening or closing amount of the furniture door so as to prevent damage as well as noise owing to the friction between the furniture door and a furniture wall.

To accomplish the above objective, according to the present invention, there is provided a furniture hinge for increasing the jumping length of a furniture door, includes: a body part disposed between a furniture wall and a furniture door; a wall fixing part for coupling the body part to the mounting position of the furniture wall in a locking manner; a movement part for reciprocatingly moving along a guide shaft in a state, in which the movement part is coupled to the body part through the guide shaft; a hinge part for guiding the rotation direction of the furniture door in a state, in which the hinge part is coupled to the movement part through upper/lower rotation plates; a door fixing part for hinge-coupling the hinge part to the mounting position of the furniture door; and an adjustment part for adjusting the advancement and return of the movement part in a state, in which the adjustment part is accommodated in the movement part, wherein the adjustment part includes a rotation member integrally formed on the lower rotation plate so as to simultaneously rotate together with the lower rotation plate in the opening and closing process of the furniture door, and a link member hinge-coupled respectively to the rotation member and the guide shaft so as to convert the rotational motion of the rotation member into a linear motion, thereby advancing and returning the movement part with respect to the guide shaft.

The present invention as described above includes at least the following effects.

First, the entire length of the furniture hinge is changed according to the opening or closing amount of the furniture door, so that the contact between the furniture door and the corner portion of the furniture wall in the opening and closing process of the furniture door is essentially eliminated.

Secondly, even if the furniture door is completely opened, since the furniture wall and the furniture door do not come into contact with each other, peeling damage to the exterior of the furniture is prevented, as well as the contact noise is reduced, thereby improving the satisfaction of consumers.

Thirdly, since the total length of the furniture hinge is changed in the opening and closing process of the furniture door, the opening angle of the furniture door is enlarged and thus the furniture door can be formed thick, improving the quality of the furniture.

Fourth, since the furniture wall and the furniture door do not come into contact with each other in the opening and closing process of the furniture door, a load applied to the furniture door is not transmitted to the furniture hinge, thereby preventing damage to and deformation of the furniture hinge.

Figure 1:
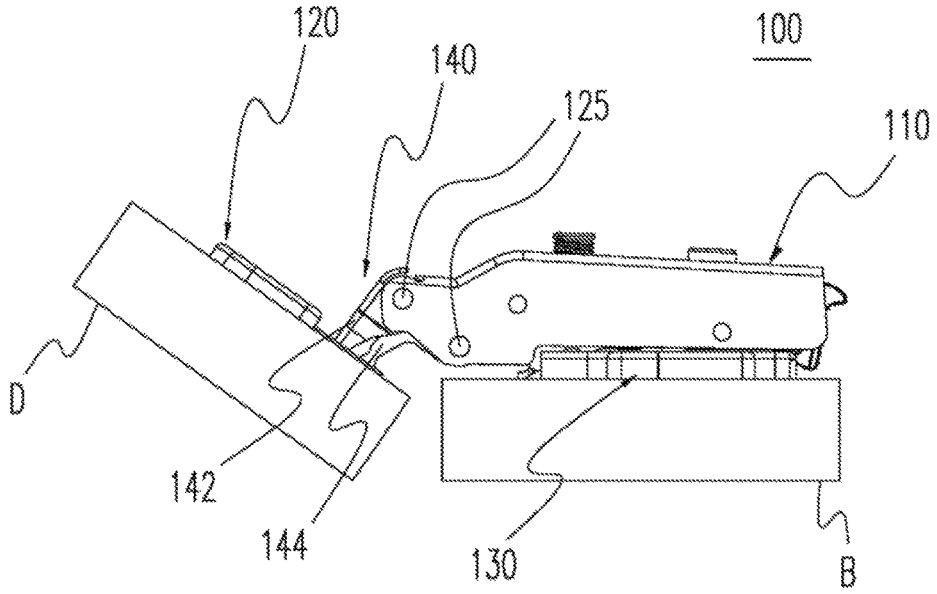
Fig. 1 PRIOR ART
FIG. 1 is a sectional view showing an installation state of a prior art furniture hinge.
Figure 2:
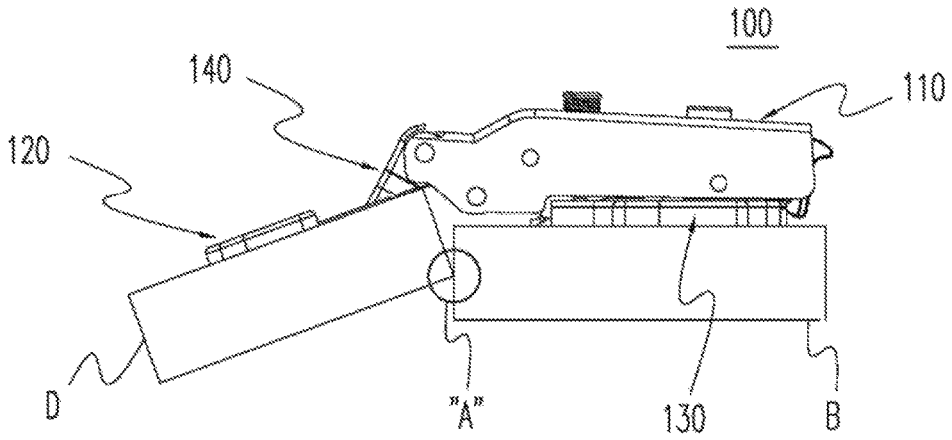
Fig. 2 PRIOR ART
FIG. 2 is a sectional view showing a fully opened state of the prior art furniture hinge.
Figure 3:
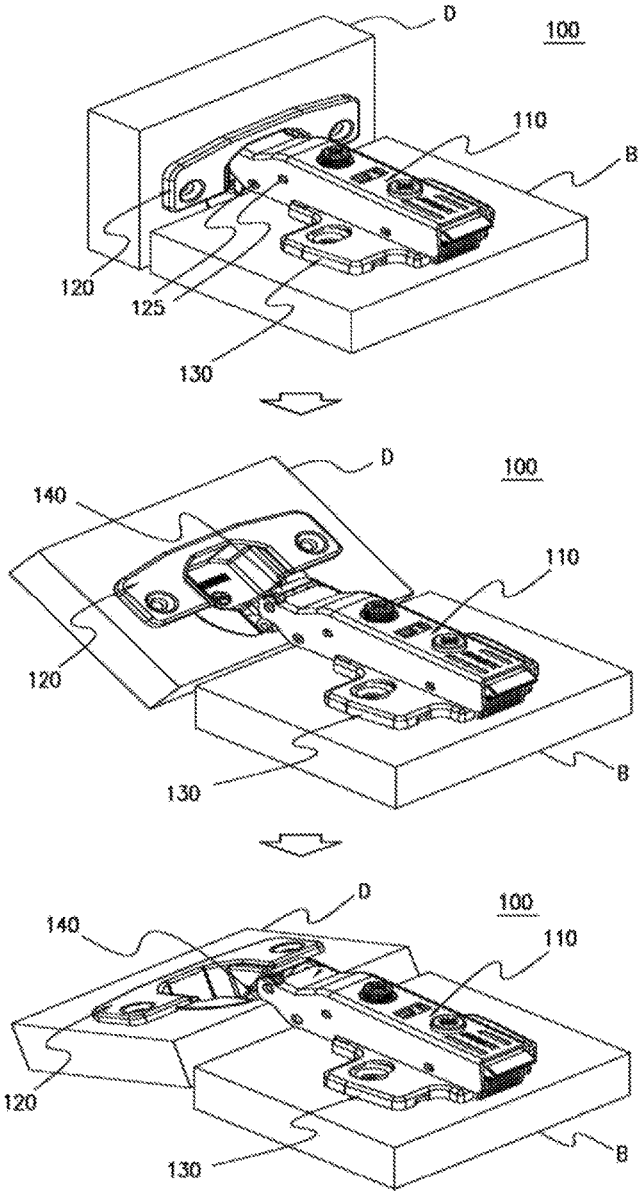
Fig. 3 PRIOR ART
FIG. 3 is a perspective view showing an operation process of the prior art furniture hinge.
Figure 4:
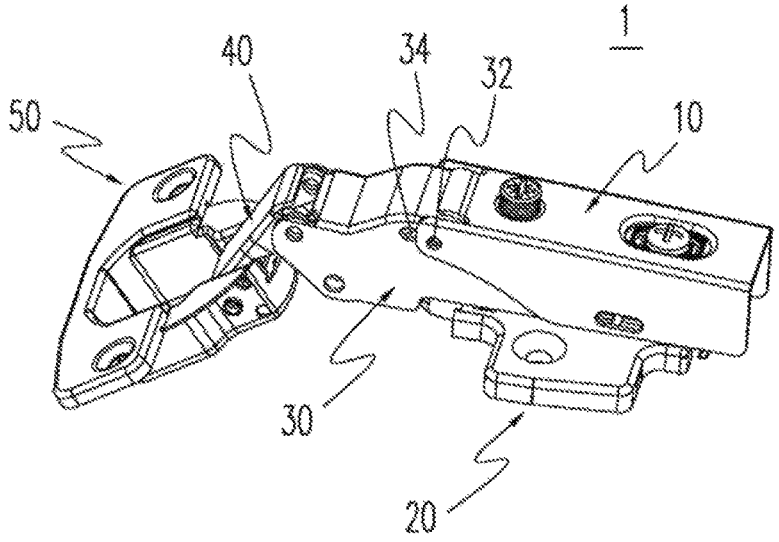
FIG. 4 is a view showing a furniture hinge according to a first embodiment of the present invention.

| | | | |
|---|---|---|---|
| B: | furniture wall | D: | furniture door |
| 10: | body part | 12: | inner plate |
| 12-2: | cutout hole | 12-4: | bolt hole |
| 12-6, 12-8: | front/rear hooks | | |
| 12-9: | buffering groove | | |
| 14: | outer plate | | |
| 14-2, 14-6: | elongated hole | | |
| 14-4: | bolt hole | 16: | setting bolt |
| 18: | tension bolt | 20: | wall fixing part |
| 22: | front holding protrusion | | |
| 24: | rear holding protrusion | | |
| 30: | movement part | 31: | elongated hole |
| 32: | guide shaft | 34: | guide hole |
| 36: | elongated hole | 38: | elongated hole |
| 40: | hinge part | 42: | upper rotation plate |
| 44: | lower rotation plate | | |
| 50: | door fixing part | | |
| 60: | adjustment part | 62: | rotation member |
| 64: | link member | 70: | guide part |
| 72: | guide hole | 74: | guide shaft |
| 76: | elastic ring | | |

DETAILED DESCRIPTION OF THE PREFERRED EMBODIMENT

Hereinafter, preferred embodiments of the present invention will be described in detail.

[Embodiment 1 ]

As shown in FIG. 4 to FIG. 8, a furniture hinge for increasing the jumping length of a furniture door, according to the present invention, includes: a body part 10 disposed between a furniture wall B and a furniture door D; a wall fixing part 20 for coupling the body part 10 to the mounting position of the furniture wall B in a locking manner; a movement part 30 for reciprocatingly moving along a guide shaft 32 in a state, in which the movement part 30 is coupled to the body part 10 through the guide shaft 32; a hinge part 40 for guiding the rotation direction of the furniture door D in a state, in which the hinge part 40 is coupled to the movement part 30 through upper/lower rotation plates 42, 44; a door fixing part 50 for hinge-coupling the hinge part 40 to the mounting position of the furniture door D; and an adjustment part 60 for adjusting the advancement and return of the movement part 30 in a state, in which the adjustment part 60 is accommodated in the movement part 30, wherein the adjustment part 60 includes a rotation member 62 integrally formed on the lower rotation plate 44 so as to simultaneously rotate together with the lower rotation plate 44 in the opening and closing process of the furniture door, and a link member 64 hinge-coupled respectively to the rotation member 62 and the guide shaft 32 so as to convert the rotational motion of the rotation member 62 into a linear motion, thereby advancing and returning the movement part 30 with respect to the guide shaft 32.

First, the furniture hinge 1 according to the first embodiment includes the body part 10, the wall fixing part 20, the movement part 30, the hinge part 40 and the door fixing part 50, which are coupled to each other, and, particularly, furniture hinge 1 further includes the adjustment part 60 for advancing and returning the movement part 30 in the opening and closing process of the furniture door D.

Figure 5:
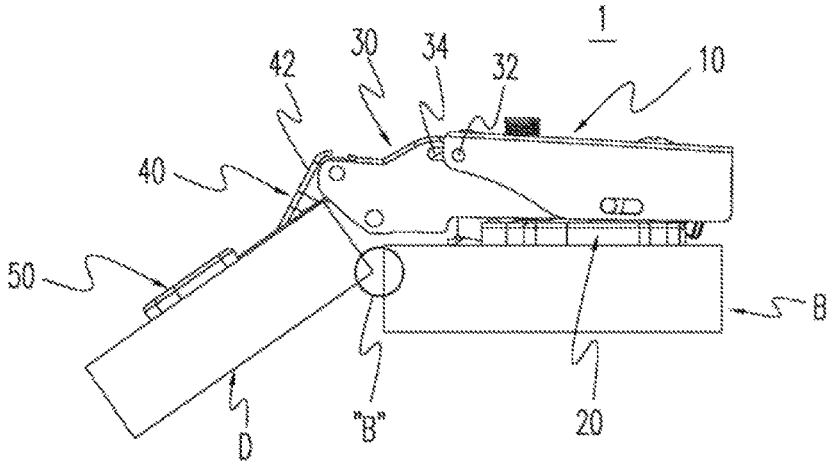
FIG. 5 is a sectional view showing an operation state of the furniture hinge according to the first embodiment.
Figure 6:
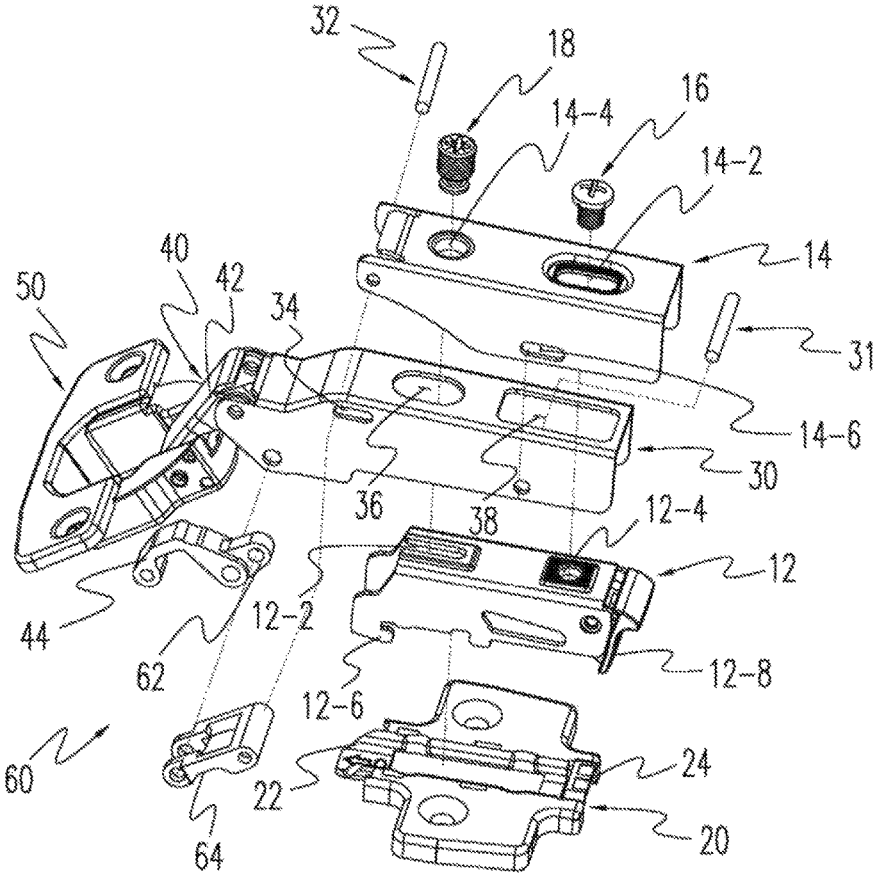
FIG. 6 is a perspective view showing an exploded state of the furniture hinge according to the first embodiment.
Figure 7:
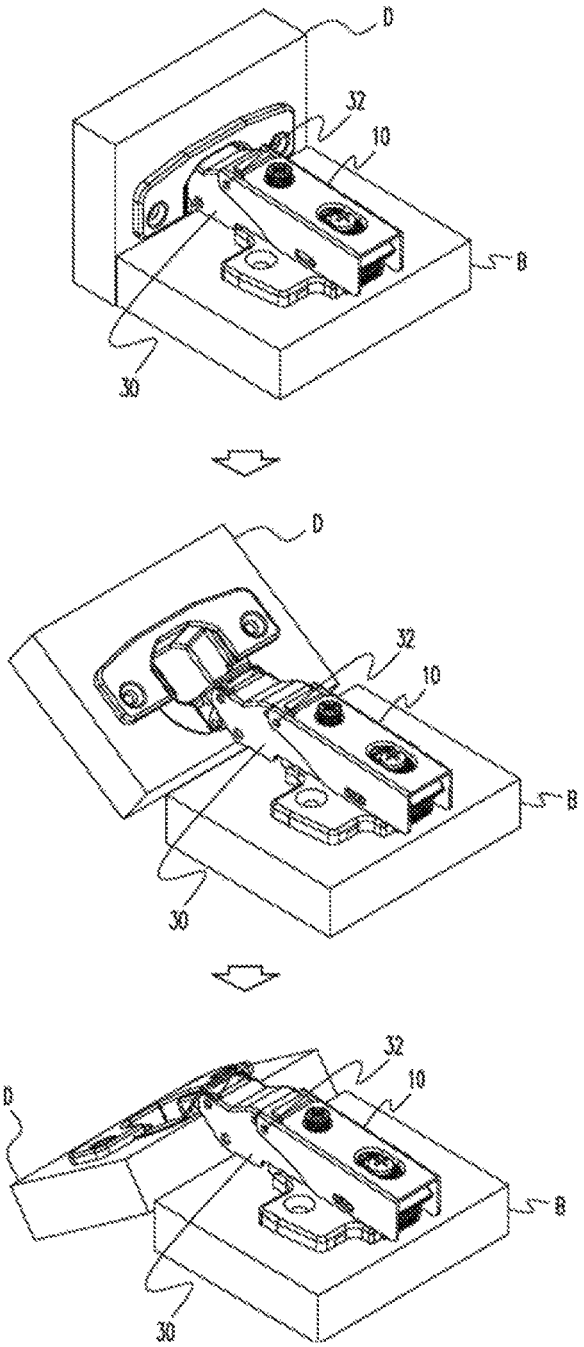
FIG. 7 is a perspective view showing an operation process of the furniture hinge according to the first embodiment.

Particularly, the furniture hinge 1 has a structure, in which the length of the movement part 30 is changed corresponding to the length of the guide hole 34 described hereinafter during the advancing or returning of the movement part 30, wherein the corner of the furniture door D and the furniture wall B do not come into contact with each other even though the furniture door D is completely opened, as shown in FIG. 5.

Herein, the body part 10 constitutes the exterior of the furniture hinge 1 and supports the entire load of the furniture door D, wherein the body part 10 provides a route for the advancement and return of the movement part 30 in the opening and closing processes of the furniture door D in a state, in which the body part 10 is provided between the furniture wall B and the furniture door D.

Besides, the body part 10 includes an inner plate 12 and an outer plate 14 which are coupled to each other and come into contact with the inner circumferential surface and the outer circumferential surface of the movement part 30 and, particularly, includes a setting bolt 16 and a tension bolt 18 which are essentially required for the engagement between the inner plate 12 and the outer plate 14 or between the inner plate 12 and the movement part 30.

In addition, the inner plate 12 is fixed to the wall fixing part 20 through front/rear hooks 12-6, 12-8, and includes a cutout hole 12-2 which are fitted to the lower end portion of the tension bolt 18 and a bolt hole 12-4 to which the setting bolt 16 is fastened.

Furthermore, the outer plate 14 covers the outer circumferential surface of the movement part 30 so as to perform a cover function, and has an elongated hole 14-2 and a bolt hole 14-4 respectively, such that the elongated hole 14-2 provides a clearance space of the setting bolt 16 and the tension bolt 18 is fastened to the bolt hole 14-4. Of course, the outer plate 14 is formed with an elongated hole 14-6 for reciprocatingly moving with respect to the guide shaft 31 of the movement part 30, which will be described hereinafter.

The setting bolt 16 is to set the positions of the inner plate 12 and the outer plate 14 and fastened to the bolt hole 12-4 of the inner plate 12 via the elongated hole 14-2 of the outer plate 14.

The tension bolt 18 is to adjust the tension of the inner plate 12 and the outer plate 14 and is coupled to the bolt hole 14-4 of the outer plate 14 via the elongated hole 36 of the movement part 30. Particularly, the tension bolt 18 includes a concave groove formed at the lower end portion thereof such that the cutout hole 12-2 is held on the concave groove.

The wall fixing part 20 is coupled by the bolt to the mounting position of the furniture wall B in contact with the mounting position of the furniture wall B, and includes a front holding protrusion 22 and a rear holding protrusion 24, with which the front hook 12-6 and the rear hook 12-8 of the inner plate 12 are respectively engaged.

Of course, even though the front holding protrusion 22 and the rear holding protrusion 24 are formed on the wall fixing part 20 in the present application, it is also possible to detachably couple the inner plate 12 within the technical scope of the present application.

The movement part 30 is interposed between the inner plate and the outer plate 14 so as to advance and return in the opening and closing process of the furniture door D, wherein the movement part 30 is accommodated in the outer plate 14 and coupled through the guide shaft 32.

Further, the movement part 30 includes the guide hole 34, through which the guide shaft 32 passes, the elongated hole 36 for reciprocatingly moving with respect to the tension bolt 18, and an elongated hole 38 for reciprocatingly moving with respect to the setting bolt 16. Particularly, the guide hole 34 is formed in the form of an elongated hole in consideration of the movement amount of the movement part 30.

Herein, if the guide shaft 32 is provided at the mounting position of the outer plate 14 in a state, where the movement part 30 is coupled to the outer plate 14 of the body part 10, then the guide shaft 32 passes through the guide hole 34 so that the guide hole 34 is advanced and returned with respect to the guide shaft 32.

The hinge part 40 is to couple the movement part 30 and the door fixing part 50, and includes the upper rotation plate 42 hinge-coupled respectively to the movement part 30 and the door fixing part 50 so as to provide elastic force and the lower rotation plate 44 hinge-coupled to the movement part 30 and the door fixing part 50 respectively.

The door fixing part 50 is accommodated in the concave groove of the furniture door D and fixed by a bolt, wherein the front end portion of the upper rotation plate 42 and the front end portion of the lower rotation plate 44 are respectively hinge-coupled to the door fixing part 50.

The adjustment part 60 is to convert the rotational motion generated in the opening and closing process of the furniture door D into a linear motion so as to provide the operating force required for the advancing and returning the movement part 30, and includes the rotation member 62 accommodated in the movement part 30 and the link member 64 operated by the rotation member 62.

In addition, the rotation member 62 provides operating force required for advancing and returning the movement part 30, and is integrally formed at the rear side of the lower rotation plate 44 so as to rotate forward or backward along a hinge shaft P1 of the lower rotation plate 44.

Besides, the link member 64 is hinge-coupled to the rotation path of the rotation member 62, preferably to the rotation member 62 and the guide shaft 32 respectively, and adjusts a distance between the rotation member 62 and the guide shaft 32.

Herein, the adjustment part 60 transmits the rotational force of the furniture door D by the rotation member 62, and provides the operating force according to the advancing and returning of the movement part 30 by the link member 64.

That is, when the rotation member 62 rotates in the clockwise direction in the drawings, the movement part 30 moves forwards, and when the rotation member 62 rotates in the counterclockwise direction in the drawings, the movement part 30 moves backwards.

Hereinafter, the operation according to the present invention will be described with reference to FIG. 8.

Figure 8:
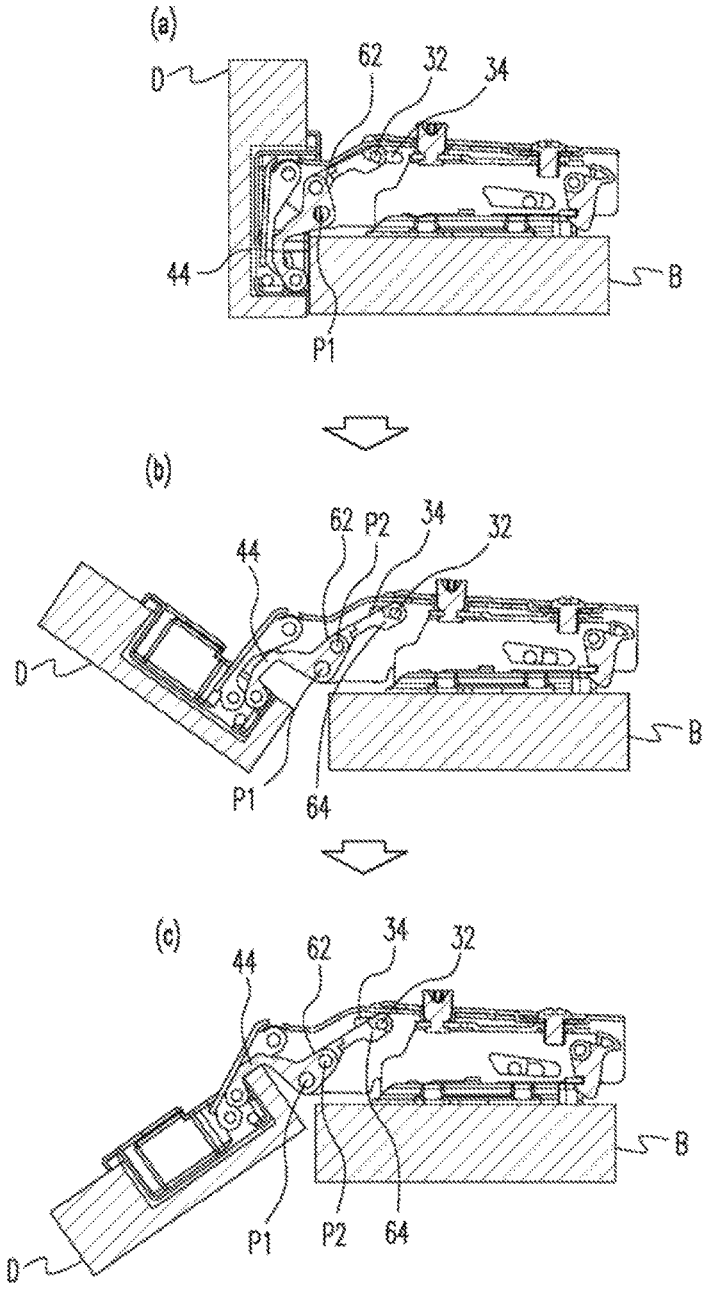
FIG. 8 is a sectional view showing an operation process of the furniture hinge according to the first embodiment.

First, as shown in FIG. 8(*a*), when the furniture door D is completely closed on the furniture wall B, the lower rotation plate 44 does not rotate, and thus the rotation member 62 is in position.

In addition, when the furniture door D is completely closed, the rotation member 62 and the link member 64 are in a set state, so that the guide shaft 32 is positioned at the left side of the guide hole 34 on the drawing.

If the furniture door D is opened as shown in FIG. 8(*b*) and FIG. 8(*c*), the lower rotation plate 44 is rotated along the hinge shaft P1 in the clockwise direction on the drawings and, at the same time, the rotation member 62 is rotated in the clockwise direction on the drawings.

Subsequently, since the link member 64 coupled to the rotation member 62 through a hinge shaft P2 moves while the rotation member 62 rotates, the distance between the hinge shaft P1 and the guide shaft 32 becomes relatively long.

That is, since the guide hole 34 moves in the left direction on the drawings with respect to the guide shaft 32 according to the movement amount of the link member 64, the movement part 30 advances by the rotation amount of the rotation member 62.

Herein, since the movement part 30 is in a state, in which the elongated hole 36 and the elongated hole 38 are respectively formed therein, the movement part 30 can move in the left direction on the drawing with respect to the setting bolt 16 and the tension bolt 18 so as to advance.

Furthermore, as shown in FIG. 8(*c*), when the furniture door D is fully opened, the rotation member 62 and the link member 64 are in a completely rotated state and the guide shaft 32 is positioned at the right side of the guide hole 34 in the drawing.

Therefore, as the opening amount of the furniture door D increases, the movement part 30 advances and the length of the furniture hinge 1 is increased.

Particularly, as shown in FIG. 8(*c*), the furniture wall B and the furniture door D are sufficiently spaced apart from each other so that the furniture wall B and the furniture door D do not come into contact with each other even if the movement part 30 is fully advanced.

That is, even if the furniture door D is completely opened, since the furniture wall B and the corner portion of the furniture door D do not come into contact with each other, the furniture is prevented from being damaged, such as the exterior of the furniture being peeled off and the like, thereby extending the service life.

[Embodiment 2 ]

Figure 9:
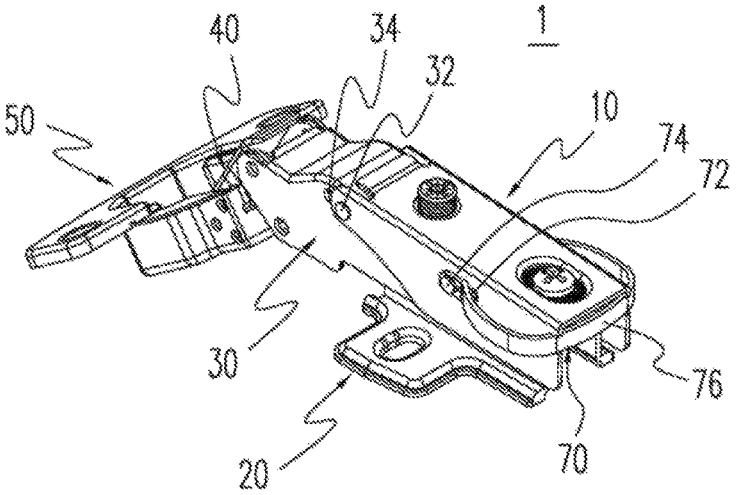
FIG. 9 is a view showing a furniture hinge according to a second embodiment of the present invention.
Figure 10:
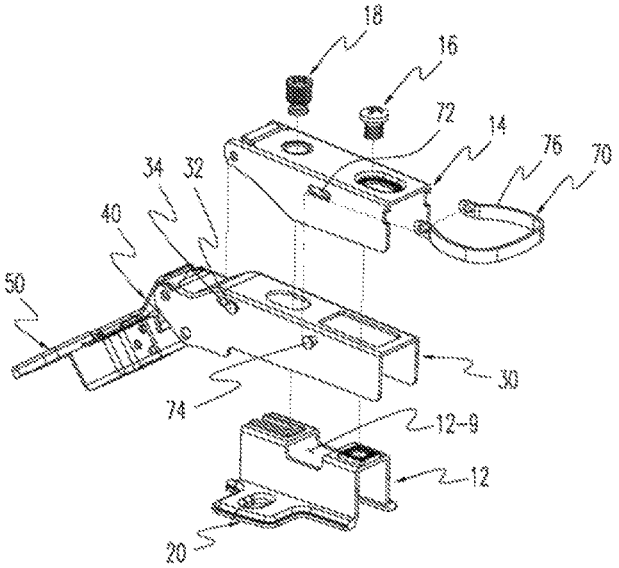
FIG. 10 is a perspective view showing an exploded state of a furniture hinge according to the second embodiment.
Figure 11:
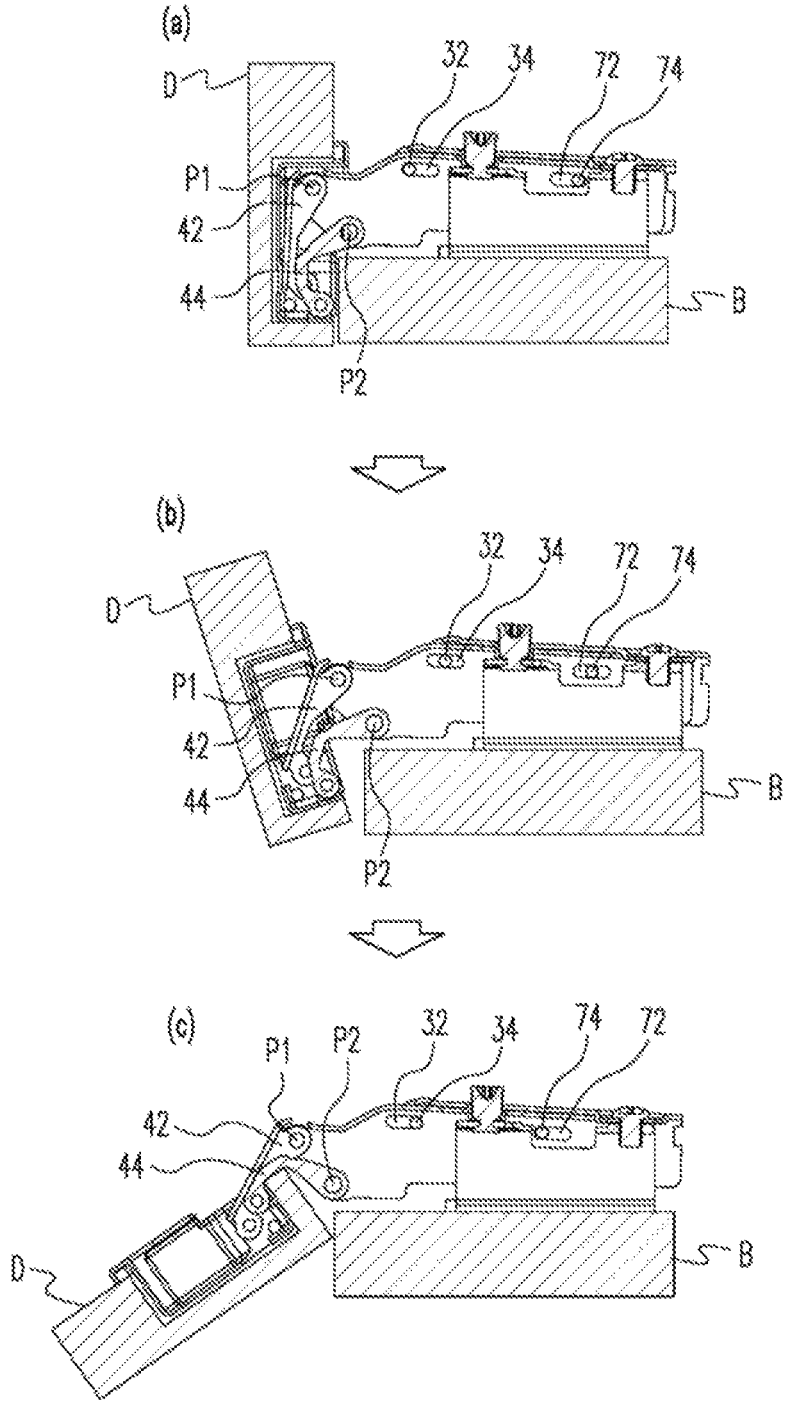
FIG. 11 is a sectional view showing an operation process of the furniture hinge according to the second embodiment, Explanation of essential reference numerals in drawings

As shown in FIG. 9 to FIG. 11, a furniture hinge 1 according to the present invention, includes: a body part 10 disposed between the furniture wall B and the furniture door D; a wall fixing part 20 for fixing an inner plate 12 of the body part to the furniture wall B; a movement part 30 for reciprocatingly moving with respect to a guide shaft 32 in a state, in which the movement part 30 is coupled to an outer plate 14 of the body part 10 through the guide shaft 32; a hinge part 40 for guiding the rotation direction of the furniture door D in a state, in which the hinge part 40 is coupled to the movement part 30 through upper/lower rotation plates 42, 44; a door fixing part 50 for coupling the hinge part 40 to the furniture door D; and a guide part 70 provided at the movement path of the movement part 30 so as to guide the reciprocating movement of the movement part 30.

Furthermore, the guide part 70 includes: a guide hole 72 formed in the outer plate 14; a guide shaft 74 for reciprocatingly moving along the guide hole 72 in a state, in which the outer plate 14 and the movement part 30 are coupled; and an elastic ring 76 coupled to the outer circumferential surface of the outer plate 14 so as to provide the return force of the guide shaft 74.

Herein, the furniture hinge 1 according to the second embodiment includes the body part 10 such that the wall fixing part 20, the movement part 30, the hinge part 40, and the door fixing part 50 are coupled to each other. Additionally speaking, the furniture hinge 1 according to the second embodiment particularly includes the guide part 70 provided instead of the adjustment part 60 of the first embodiment.

The body part 10 has the inner plate 12 and the outer plate 14, which are in contact with the inner circumferential surface and the outer circumferential surface of the movement part 30 respectively, and a buffering groove 12-9, which is formed on the top surface of the inner plate 12, preferably in the center of the top surface of the inner plate 12, so as to reduce a contact area with the movement part 30 and buffer an external load.

Particularly, it is different that the inner plate 12 of the body part 10 and the wall fixing part 20 are formed integrally with each other, wherein it is also possible to separately form the inner plate 12 and the wall fixing part 20 from each other within the technical scope of the present application.

In addition, the body part 10, the wall fixing part 20, the movement part 30, the hinge part 40 and the door fixing part 50 among the essential constituent elements according to the second embodiment are substantially the same as the corresponding elements according to the first embodiment and thus the explanation thereof will be omitted. Hereinafter, the guide hole 72, the guide shaft 74 and the elastic ring 76 of the guide part 70 will be described.

The guide hole 72 is to couple the body part 10 and the movement part 30 to each other and is formed in the form of an elongated hole along the lengthwise direction of the outer plate at both side portions of the outer plate 14. Particularly, the guide hole 72 is formed to have a shape corresponding to that of the guide hole 34 as well as a length and a height corresponding to those of the guide hole 34.

In addition, the guide shaft 74 is to couple the body part 10 and the movement part 30 to each other and is mounted along the widthwise direction of the movement part 30 so as to be fixed to the movement part 30, wherein the guide shaft 74 is formed in a shape corresponding to that of the guide shaft 32.

Besides, the elastic ring 76 is coupled to both end portions of the guide shaft 74 so as to provide elastic force, thereby increasing the coupling force between the outer plate 14 and the movement part 30 as well as preventing the separation thereof.

Therefore, the body part 10 and the movement part 30 are coupled to each other through the guide shafts 32, 74 and the guide holes 34, 72 so that the advancing and returning of the movement part 30 is performed in the opening and closing process of the furniture door D.

Hereinafter, the operation according to the present invention will be described with reference to FIG. 11.

First, as shown in FIG. 11(*a*), when the furniture door D is completely closed on the furniture wall B, the upper/lower rotation plates 42, 44 do not rotate, and thus the movement part 30 is in position.

Besides, when the furniture door D is completely closed, the guide shaft 32 is positioned at the left side of the guide hole 34 in the drawing, and the guide shaft 74 is positioned at the right side of the guide hole 72 in the drawing.

If the furniture door D is opened, as shown in FIG. 11(*b*) and FIG. 11(*c*), the upper/lower rotation plates 42, 44 rotate along the hinge shafts P1, P2 so that the movement part 30 advances by the rotation amount of the upper/lower rotation plates.

That is, the movement part 30 moves with respect to the guide shaft 32 and the guide hole 72 in the left direction in the drawings.

Particularly, as shown in FIG. 11(*c*), when the furniture door D is fully opened, the guide shaft 32 is positioned at the right side of the guide hole 34 in the drawing, and the guide shaft 74 is positioned at the left side of the guide hole 72 in the drawing.

Meanwhile, when closing the furniture door D, the furniture door D is closed slowly in the sequence shown in FIG. 11(*c*) to FIG. 11(*a*), wherein the return process of the guide shaft 74 is smoothly carried out by the elastic force of the elastic ring 75.

Therefore, it would be understood that the furniture hinge according to the present invention described hereinabove is not limited to the forms described in the example embodiments and it would be apparent to a person skilled in the art, to which the present invention belongs, that the technical and protective scope of the present invention shall be defined by the following claims. In addition, it should be also understood that all modifications, changes and equivalences within the technical scope of the present invention defined by the following claims belong to the technical scope of the present invention.

What is claimed is:

1. A furniture hinge for increasing the jumping length of a furniture door, comprising:

a body part;

a wall fixing part coupling the body part to the mounting position of a furniture wall in a locking manner;

a movement part reciprocatingly moving along a guide shaft in a state, in which the movement part is coupled to the body part through the guide shaft;

a hinge part guiding the rotation direction of a furniture door in a state, in which the hinge part is coupled to the movement part through upper and lower rotation plates;

a door fixing part hinge-coupling the hinge part to the mounting position of the furniture door, wherein the door fixing part is coupled to the movement part via the hinge part; and an adjustment part adjusting the advancement and return of the movement part in a state, in which the adjustment part is accommodated in the movement part, wherein the body part comprises an inner plate accommodated inside an inner circumferential surface of the movement part and having a first bolt hole and a cutout hole, an outer plate covering an outer circumferential surface of the movement part and having a second bolt hole and a first elongated hole, a setting bolt coupling the inner plate and the outer plate in a state, in which the setting bolt goes through the first elongated hole and is fastened to the first bolt hole of the inner plate; and a tension bolt coupling the inner plate and the outer plate in a state, in which the tension bolt is fastened to the second bolt hole of the outer plate and accommodated in the cutout hole, wherein the adjustment part comprises:

a rotation member integrally formed on the lower rotation plate to simultaneously rotate together with the lower rotation plate in an opening process and a closing process of the furniture door; and a link member hinge-coupled to the rotation member and the guide shaft to convert the rotational motion of the rotation member into a linear motion, thereby advancing and returning the movement part with respect to the guide shaft.

2. The furniture hinge for increasing the jumping length of a furniture door according to claim 1, wherein the movement part is interposed between the inner plate and the outer plate of the body part, and comprises a guide hole for reciprocatingly moving with respect to the guide shaft, a second elongated hole for reciprocating with respect to the tension bolt of the body part, and a third elongated hole for reciprocatingly moving with respect to the setting bolt of the body part.

* * * * *